United States Patent [19]

Stratman

[11] 4,024,791

[45] May 24, 1977

[54] GUN MUZZLE FLASH SUPPRESSOR

[75] Inventor: Urban Frederick Stratman, Taylor Ridge, Ill.

[73] Assignee: The United States of America as represented by the Secretary of the Army, Washington, D.C.

[22] Filed: Oct. 28, 1975

[21] Appl. No.: 626,012

[52] U.S. Cl. ..... 89/14 B

[51] Int. Cl.[2] ..... F41F 17/12

[58] Field of Search ..... 89/14 B, 14 C, 14 D, 89/14 E

[56] References Cited

UNITED STATES PATENTS

| | | | |
|---|---|---|---|
| 786,230 | 3/1905 | McClean | 89/14 C |
| 817,134 | 4/1906 | Smith | 89/14 C |
| 1,636,357 | 7/1927 | Cutts | 89/14 C |
| 2,212,683 | 8/1940 | Hughes | 89/14 C |
| 2,223,014 | 11/1940 | Galliot et al. | 89/14 C |
| 2,765,706 | 10/1956 | Strohl | 89/14 C |
| 2,780,962 | 2/1957 | Ressler et al. | 89/14 B |
| 2,870,679 | 1/1959 | Collins | 89/14 C |
| 2,883,781 | 4/1959 | Harvey | 89/14 C X |
| 3,021,633 | 2/1962 | Beretta | 89/14 C X |
| 3,141,376 | 7/1964 | Chinn | 89/14 C |

FOREIGN PATENTS OR APPLICATIONS

| | | | |
|---|---|---|---|
| 849,226 | 11/1939 | France | 89/14 C |

*Primary Examiner*—David H. Brown

*Attorney, Agent, or Firm*—Nathan Edelberg; Harold H. Card, Jr.; Robert O. Richardson

[57] ABSTRACT

This invention relates to new and improved methods and apparatus for suppression of the light emissions of weapon systems capable of sustained gunfire, such as machine guns, and involves utilization of the projectile propellent gases to aspirate ambient air into the barrel of the weapon for ad-mixture with the gases, whereby the intensity of the light emissions during sustained firing of the weapon are substantially reduced. In accordance with the present invention, a plurality of restricted orifices are provided in the gun barrel adjacent the muzzle thereof through which ambient air is aspirated.

2 Claims, 3 Drawing Figures

GUN MUZZLE FLASH SUPPRESSOR

GOVERNMENT RIGHTS

The invention described herein may be manufactured and/or used by or for the Government for governmental purposes without the payment of any royalty thereon.

BACKGROUND OF THE INVENTION

Heretofore, difficulties have been encountered in the use of rapid fire weapons, such as machine guns, during sustained periods of firing, particularly after dark, because of the light emissions from the barrel of the gun adjacent the muzzle thereof, which emissions blend together to provide in effect a continuous illuminated indicator of the firing source to pin point the location of the weapon.

SUMMARY OF THE INVENTION

By utilization of the present invention, these problems and difficulties, among others, of the prior art are substantially overcome by the provision of a plurality of apertures circumscribing the periphery of the gun barrel adjacent the muzzle thereof with their axes angled with respect to the longitudinal axis of the gun barrel to communicate the interior of the gun barrel with ambient air, whereby the gases propelling the projectile in the gun barrel aspirate the ambient air for admixing with the gases, such admixing cooling the gases and thereby substantially reducing the level of light emission illumination otherwise normally generated by such gases at the muzzle of the gun barrel under repetitive or automatic firing conditions.

DESCRIPTION OF THE PREFERRED EMBODIMENT

Figure 1:
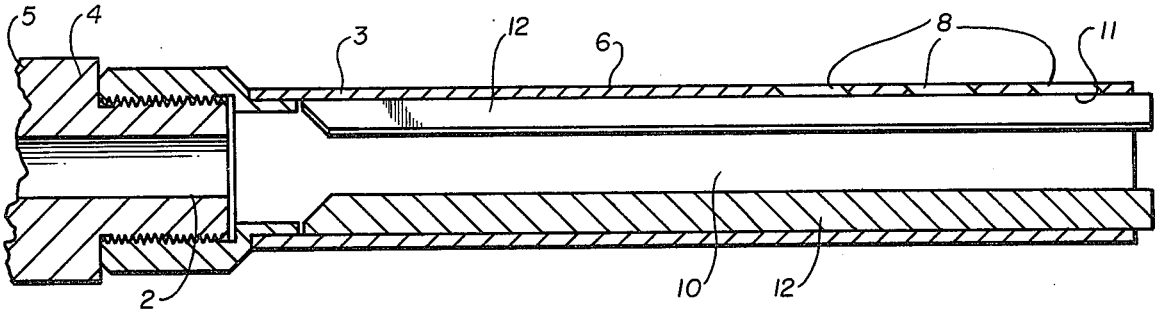
FIG. 1 is a side view in section of a gun barrel or tube incorporating the features of the present invention.
Figure 2:
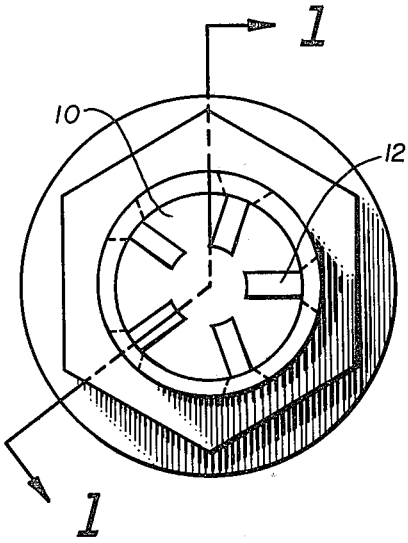
FIG. 2 is an end view of the embodiment of FIG. 1.
Figure 3:
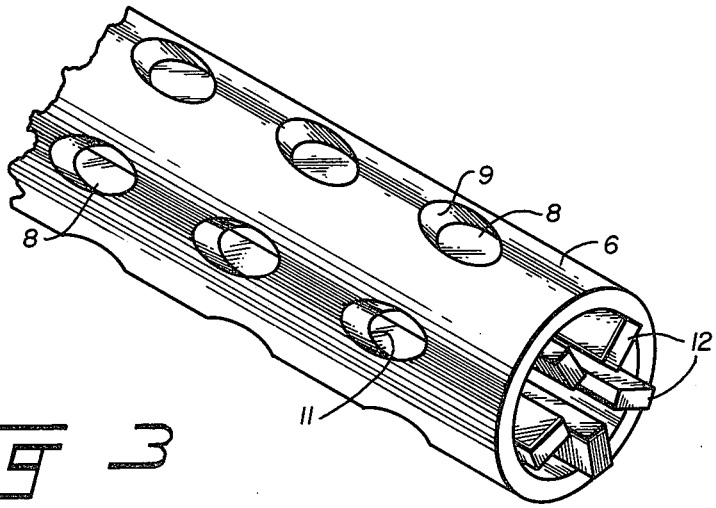
FIG. 3 is a perspective illustration of the embodiment of FIG. 1, illustrating longitudinal orifice bars and the air flow characteristics of the present invention.

Referring to FIGS. 1-3, there is shown a gun barrel or tube 2 having at its muzzle end 4 a flash suppressor device 6 of the present invention incorporated therein. The device 6 may be integral with or a separate extention 3 of the gun barrel 2. As shown in FIG. 1 the device 6 is a separate part carried by the jacket 5 of the gun barrel 2.

Circumscribing the gun barrel extension 3 is a plurality of apertures 8 of the conventional venturi type communicating the ambient atmosphere with the interior of the gun barrel. The apertures 8 are each angled with respect to the longitudinal axis of the gun barrel so that the air inlet orifices 9 or ports adjacent the outer surface of the barrel extension 3 are oriented rearwardly or breechward with respect to the longitudinal axis of the gun barrel and the inner or air outlet port 11 of each aperture is angularily oriented toward the muzzle of the gun barrel to facilitate aspiration of ambient air into the gun barrel extension 3 in the direction of flow of the gases utilized to propel projectiles through the bore 10 of the gun barrel extension 3 for admixture between the air and gases. This admixing appears, in testing, to have a cooling effect on the moving gases whereby the intensity of the flash emissions from the gun muzzle are substantially reduced, thereby minimizing visual spotting of the location of the weapon.

The holes 8 are located where the pressure of the gases in the tube is sufficiently low, as determined by testing, to permit aspiration of ambient air into the tube. If the location for the apertures is chosen where the gas internal pressure is great enough to flow through apertures to ambient, then objectionable gas "snorting" to atmosphere occurs rather than air aspiration.

The air aspiration effect on diminishing the intensity of light emissions from the gun muzzle utilizing the apertures 8 may be further enhanced by employment of a plurality of spaced bars or internal ribs 12 extending longitudinally in the gun barrel extension passageway 10, as seen in FIGS. 2 and 3. The bars 12 are arranged adjacent the apertures 8 so that the flow paths of the ambient air into the bore 10 is streamlined for delivery in the direction of the flow stream of the gases thereby minimizing turbulence in the gas flow stream to supplement and enhance the gas cooling effects of the angled apertures 8.

It can be seen that the inner edges of the baffles encircle an area of sufficient diameter for a projectile from gun tube 2 to pass through. With the baffles outer edges affixed to the inner wall of the cylindrical extension 3, it is obvious that this inner wall diameter is greater than that of the bore of the gun tube 2. Such an enlarged inner wall provides a greater volume for gas passage and accordingly reduces its pressure. Hence, the aspiration of ambient air into the tube through holes 8 in accordance with the principles of unrestricted jet pump aerodynamics.

It is desired that the present invention not be considered limited to the exact details of construction shown and described, for modifications will occur to a person skilled in the art:

I claim:

1. In a weapon tube including a gun having a muzzle, a gun muzzle flash suppressor comprising:

an extension adapted for attachment on the end of said muzzle, said extension having a cylindrical inner surface of a diameter larger than that of the inner diameter of said muzzle, said extension having a plurality of angled apertures extending through the wall thereof, said apertures being angled rearwardly toward said muzzle in a direction from the inner surface to the outer surface of said wall, a plurality of spaced baffle bars extending longitudinally along the inner surface of said wall and extending radially inwardly so the inner edges of said baffle bars encircle an area of sufficient diameter for a projectile from said gun muzzle to pass therethrough, whereby a pressure drop in said extension causes propellant gases flowing in said gun tube to aspirate ambient air into said extension for mixture with said gases, thereby to reduce the light emission from said gun tube.

2. A gun muzzle flash suppressor as set forth in claim 1 whereby said bars are arranged on said inner surface adjacent said apertures so that flow paths of ambient air into said extension is streamlined for delivery in the direction of the flow stream of said gases, thereby minimizing turbulence in the gas flow stream to supplement and enhance the gas cooling effects of said angled apertures.

* * * * *